United States Patent [19]

Schwalm

[11] 4,159,565

[45] Jul. 3, 1979

[54] COVER AND STRAIN RELIEF APPLICATOR APPARATUS

[75] Inventor: Glendon H. Schwalm, Winston-Salem, N.C.

[73] Assignee: AMP Incorporated, Harrisburg, Pa.

[21] Appl. No.: 904,082

[22] Filed: May 8, 1978

[51] Int. Cl.[2] ..... H01R 43/00

[52] U.S. Cl. ..... 29/759; 29/747; 29/760

[58] Field of Search ..... 29/747, 748, 749, 759, 29/760, 631

[56] References Cited

U.S. PATENT DOCUMENTS 3,667,102 6/1972 Guillemette et al. ..... 29/748

4,040,179 8/1977 Sanchez ..... 29/747 X

*Primary Examiner*—Carl E. Hall

*Attorney, Agent, or Firm*—Gerald K. Kita

[57] ABSTRACT

The disclosure relates to apparatus for magazine storage and assembling strain relief clips which anchor a multi-conductor cable to a cover assembled over the cable and a multi-contact connector. The apparatus further includes means for assisting an operator to slidably assemble the cover over the cable and connector prior to assembly of a strain relief clip thereto. In the instance whereby a connector is provided at opposite ends of a length of cable, two assembly stations are provided for simultaneous assembly of covers and strain relief clips at opposite ends of the cable length.

2 Claims, 9 Drawing Figures

COVER AND STRAIN RELIEF APPLICATOR APPARATUS

BACKGROUND OF THE INVENTION

The present invention relates to wire terminating connectors for insulated wire contained in an outer sheath of a multi-conductor cable, utilized in the telecommunications industry and other diversified industrial applications. Such connections enable various types of cable connections, such as, cable to additional lengths of cable, cable to a panel or cable to a printed circuit board mounting. In each assembly of connector with the individual wires of the cable, a separable cover is provided for covering the junction of the wires in the connector, and also a strain relief clip is provided to anchor the cable securely to the cover.

Such a connector is known by the trademark CHAMP, the property of AMP Incorporated, Harrisburg, Penna. Details of the connector are described in U.S. Pat. No. 3,760,335.

Cable wires are terminated in the connector by apparatus described in either of U.S. Pat. No. 3,803,695 and U.S. Pat. No. 3,758,935. Subsequently, a cover and strain relief clip are added to complete the assembly. The present invention relates to apparatus for adding the cover and strain relief clip.

SUMMARY OF THE INVENTION

According to the invention, apparatus is provided for magazine storage and for applying a plurality of strain relief clips to a work station whereat a connector and cable subassembly is located. Adjacent the work station a guide rail is provided for assisting an operator to align and slidably assemble a cover over the connector-cable subassembly. With the cover in place, a hand lever is pivoted to actuate a clamp for holding the connector-cable subassembly, together with its cover, at the work station. An operator then actuates an air valve which supplies air to a pneumatic piston, which in turn actuates a ram to forcibly impel a corresponding strain relief clip from its storage magazine into assembled relationship with the cover. The strain relief clip is forcibly pressed against the cable sheath firmly anchoring the cable in sandwiched relationship between the cover and the clip. The clip is self-latching with the cover, thereby to complete the assembly of the cover and strain relief clip to the connector-cable subassembly. The ram automatically retracts from the work station and the magazine to allow incremental advancement of additional clips to the work station. The operator then removes the completed assembly from the work station.

In practice, either a male connector or a female connector is applied to a cable as desired. It is often desired to provide a single cable length with a male connector on one end and a female connector on the other. Accordingly, the apparatus provides for two work stations whereat a male and a female connector may be applied to opposite ends of a cable simultaneously, according to the procedure of operation above described.

OBJECTS

It is an object of the present invention to provide apparatus for assembling a cover and strain relief clip to a subassembly of a multi-contact connector and a multi-conductor cable.

Another object is to provide apparatus for storing strain relief clips and for aligning and then assembling a cover for a connector-cable subassembly, and then for installing a corresponding strain relief clip which anchors the cable to the cover.

Another object is to provide apparatus for assembling covers and strain relief clips to two corresponding multi-contact connectors terminated at opposite ends of a multi-conductor cable.

Other objects and advantages of the present invention which would be apparent to one having ordinary skill in the art will become apparent from the following detailed description taken in conjunction with the accompanying drawings.

DRAWINGS

FIG. 3 is a view similar to FIG. 2 illustrating a cover and connector-cable subassembly in position at a work station and further illustrating ram insertion of a corresponding strain relief clip.

DETAILED DESCRIPTION

Figure 1:
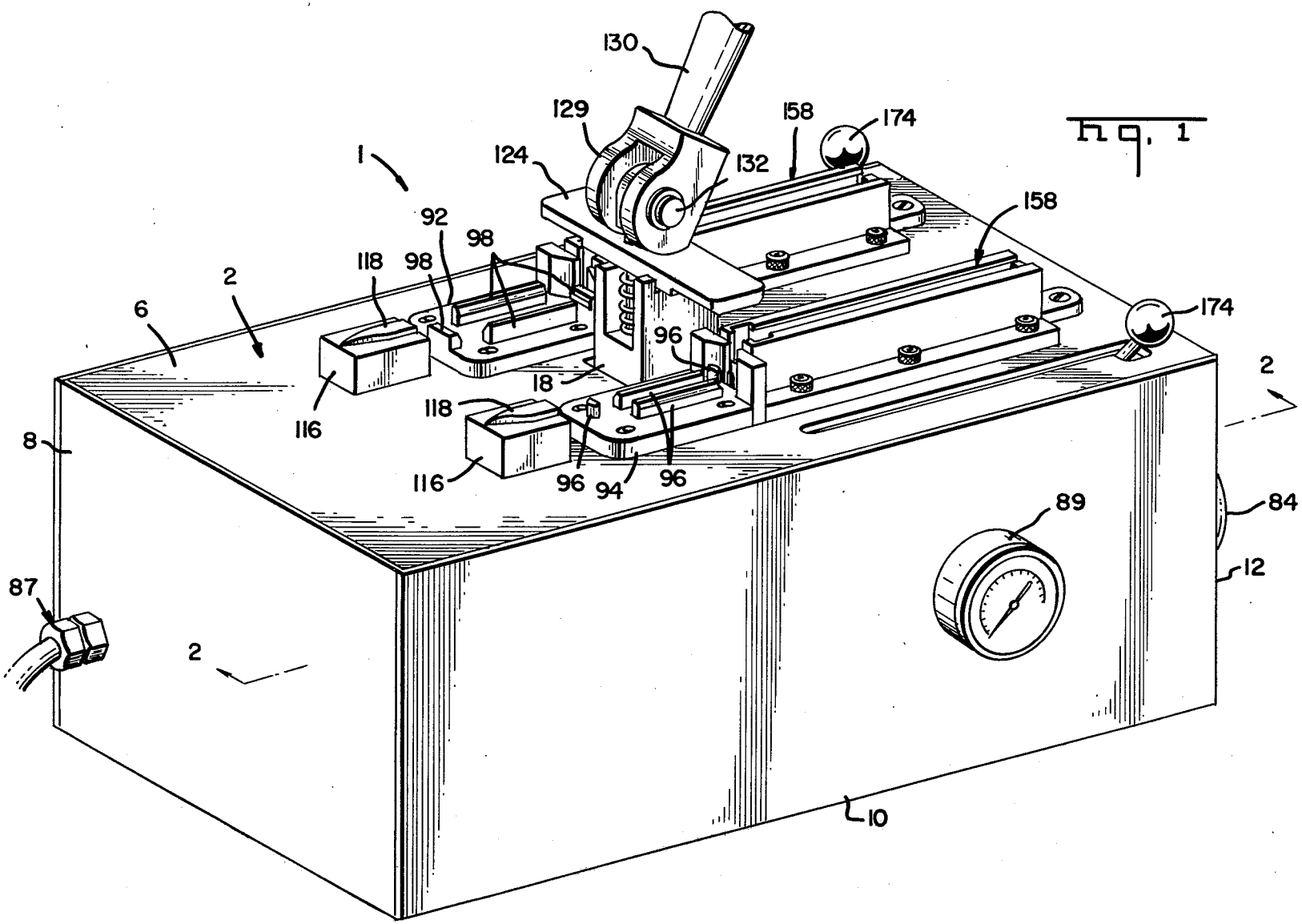
FIG. 1 is a perspective of apparatus according to the present invention for installing one or a pair of covers together with strain relief clips to corresponding subassemblies of a multi-contact connector and a multi-conductor cable.
Figure 2:
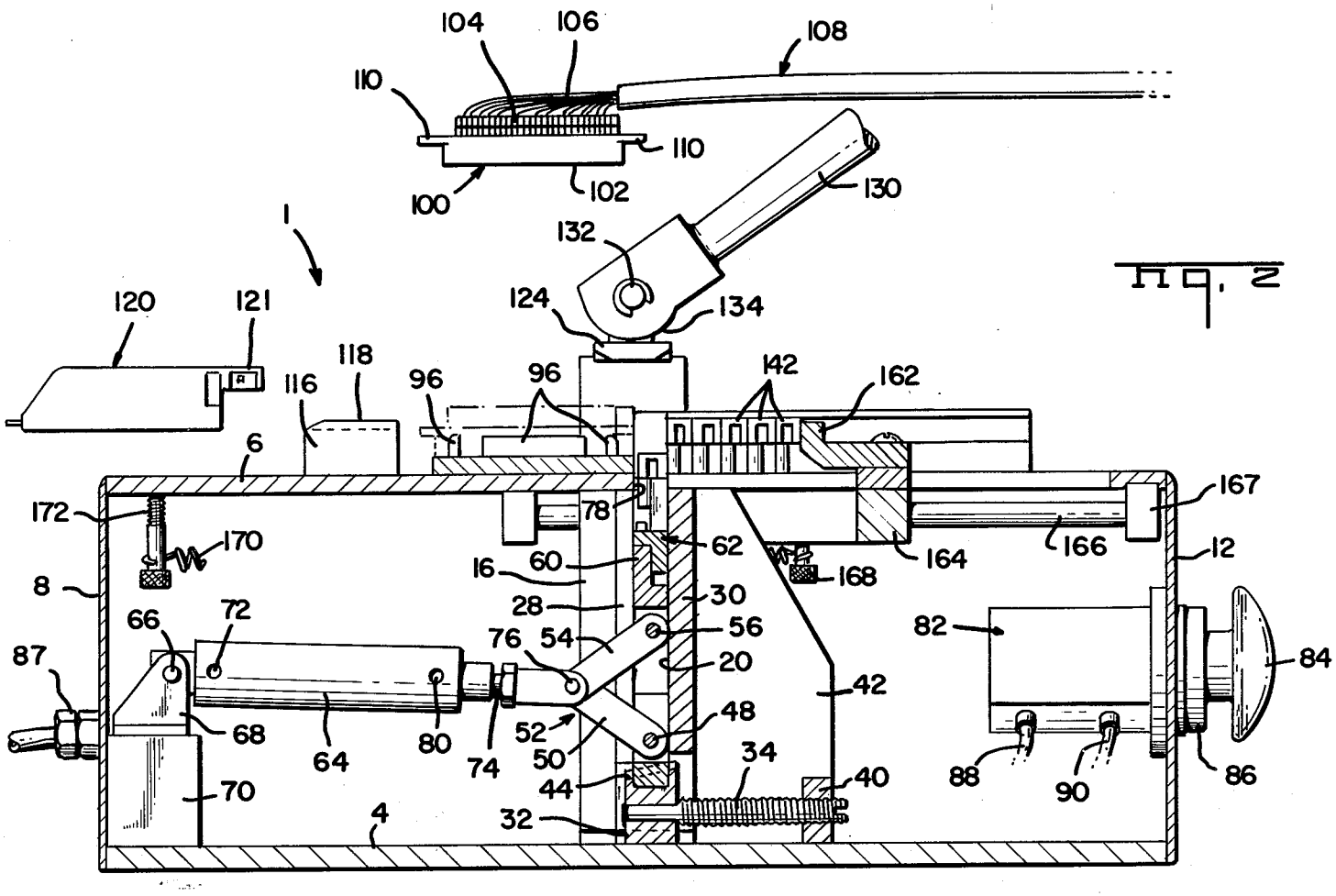
FIG. 2 is an elevation in section of the apparatus shown in FIG. 1 illustrating magazine storage of strain relief clips and further illustrating, in exploded configuration, a cover and subassembly of a multiconductor cable terminated with multicontact connector.
Figure 6:
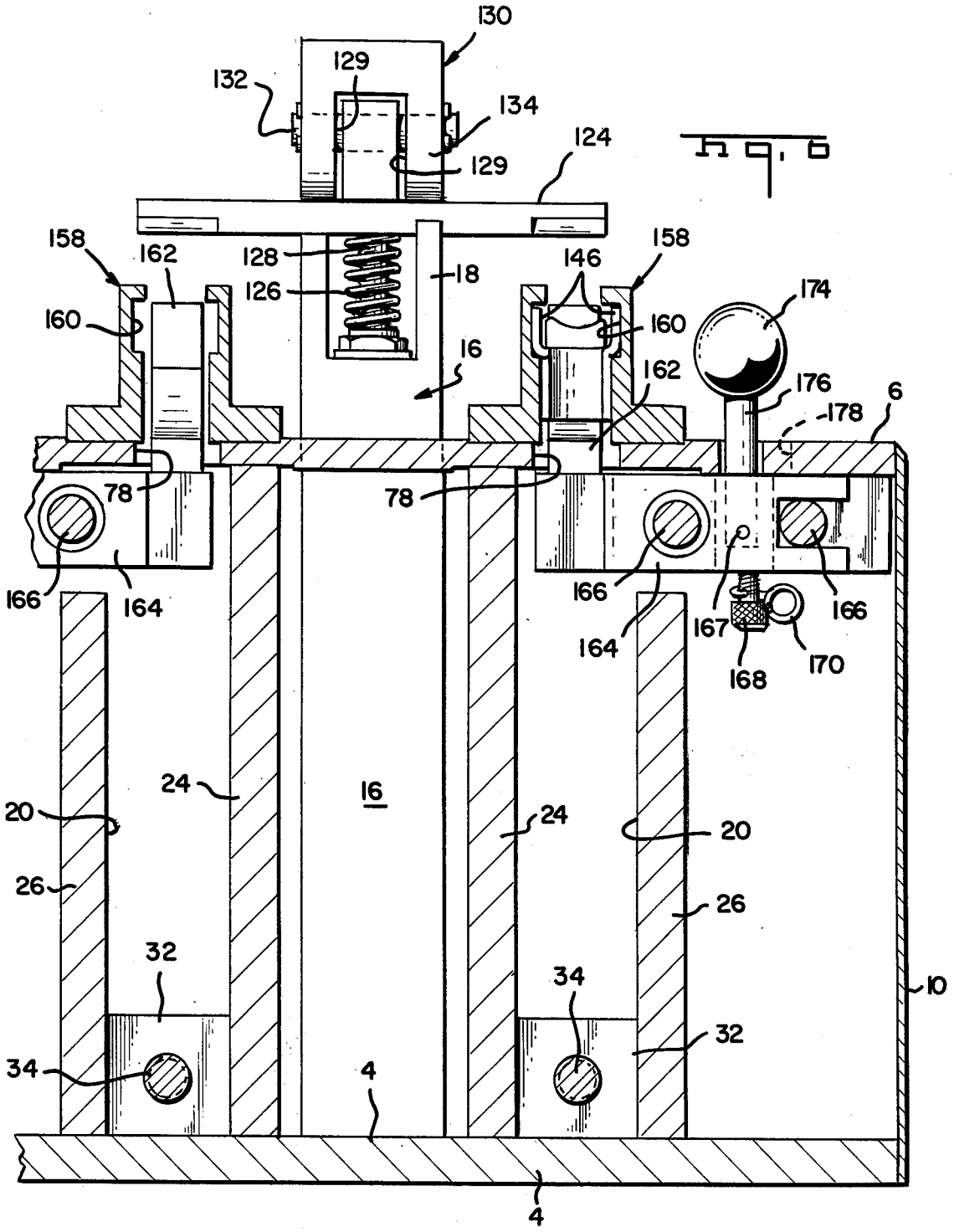
FIG. 6 is a front elevation partially in section of the apparatus shown in FIG. 1 further illustrating the magazine storage and feeding of strain relief clips.
Figure 7:
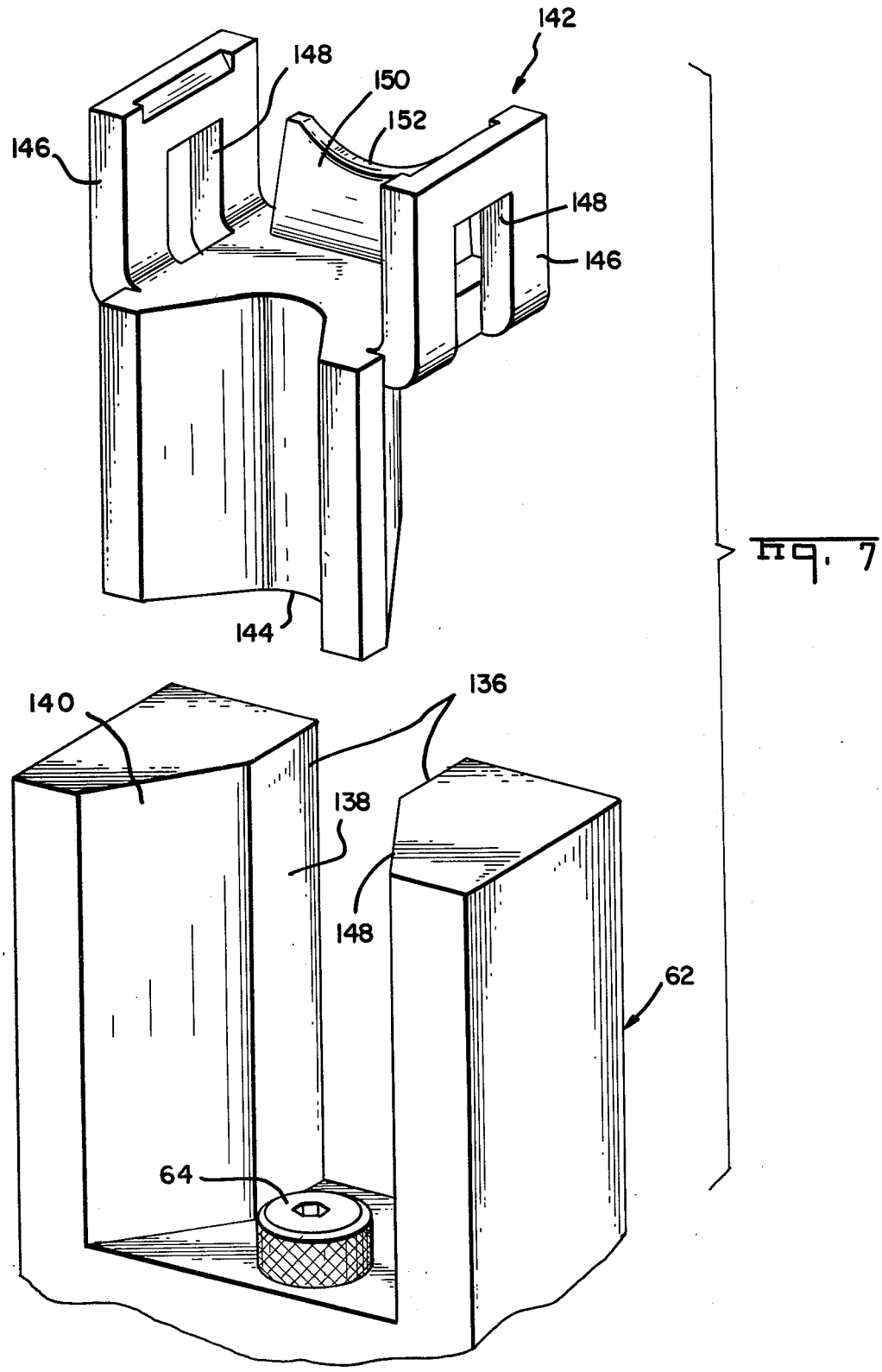

With more particular reference to FIGS. 1, 2, and 3 of the drawings, apparatus is shown generally at 1 having a housing 2 defined by a base plate 4 and a horizontal top plate 6 defining a working table spaced from the base plate 4. The housing further is defined by vertical side walls or plates 8, 10, 12 and 14. Interiorly of the housing is provided a central supporting mast or tower 16. The details of the tower are shown more particularly in FIGS. 2, 3, and 6. The tower 16 is supported on the base plate 4 and projects vertically upward therefrom, with a portion 18 projecting vertically outward above the top plate 6. Inside the housing and on either side of the mast 16 is provided a generally vertically elongate pair of ram passageways or chambers 20. Each chamber is generally rectangular and is formed by inner and outer vertical walls 24 and 26 as shown in FIG. 6.

Bridging between the inner and outer walls of each chamber, as shown in FIGS. 2 and 3, are front and back walls defined by gibs 28 and wall 30. As shown in FIGS. 2, 3, and 6 a bearing block 32 is mounted against the base plate 4 in alignment with each of the chambers 20. Each bearing block 32, such as the one shown in FIGS. 2 and 3, is adjusted in position aligned with the piston chamber by threadable adjustment of a relatively long machine screw 34 which is journaled for rotation in a corresponding block 32, at one end, and threadably secured on the other end in a cross brace 40 extending between spine plates 42. The spine plates 42 are joined to the walls 30 and to the cross brace support 40 supporting the same against the thrust of each screw 34.

Each end block 32 is machined with an inclined upper surface 44 on which is seated a generally short-rectangular thrust block 46 in a corresponding chamber 20 and pivotally secured at 48 to one end of a link 50 of a toggle linkage generally illustrated at 52. The other link 54 of the toggle linkage 52 is pivotally secured at 56 to a piston ram 58 which is generally rectangular for slidable reciprocation within the confines of a corresponding chamber 20.

As shown more particularly in FIGS. 2, 3, and 7, and 8, the top portion 60 of the ram 58 is generally L-shaped and supports thereon a specially formed tool head 62, the details of which will be explained. The die 62 is secured by a screw 64 to the ram portion 60.

As shown more particularly in FIGS. 2 and 3, each ram portion 60 may be reciprocated within a corresponding chamber 20 by actuation of a double acting pneumatic piston 64, pivotally secured at one end 66 to a mounting flange 68 which is, in turn, mounted on a pedestal 70 supported on the base plate 4. Pressurized air is supplied to the cylinder 64 through a first inlet 72 which reciprocates a piston internally of the cylinder 64 so as to project a piston rod 74 outwardly of the cylinder 64. As shown in FIG. 3, the piston rod 74 is pivotally secured to the central pivot 76 of the toggle linkage 52. Outward reciprocation of the piston rod 74 from left to right as shown in the figure will forcibly impel the ram portion 60 outwardly through an opening 78 in the top plate 6 of the housing. In similar fashion, when air is supplied to a second inlet 80 of the cylinder 64, the piston rod 74 is retracted by the cylinder 64, as shown in FIG. 2, to vertically retract the ram portion 60 internally of the housing and thereby below the top plate 6. To actuate the double acting cylinder 64, a plunger air valve 82 is mounted internally of the housing and on the wall 12. The valve 82 includes a plunger 84 projecting outwardly of the housing through a bezel. Pressurized air from a suitable source of supply (not shown) is supplied to an inlet 88. When the plunger 84 is depressed by an operator of the apparatus 1, the inlet air 88 will be supplied over an air line 90 to suitable air logic control (not shown) which will supply air first to the cylinder inlet 72. Such will thereby reciprocate the ram 60 vertically upward to project outwardly of the opening 78. Subsequently, the ram 60 will be positively retracted below the plate 6 when air is supplied to the inlet 80.

FIG. 1 illustrates a manifold inlet connection at 87 from which air is directed to the inlet 88 of the plunger actuated valve 82. FIG. 1 further illustrates at 89 an air gauge mounted on the wall 10 which is coupled to the inlet air for indicating the gauge pressure thereof.

Figure 5:
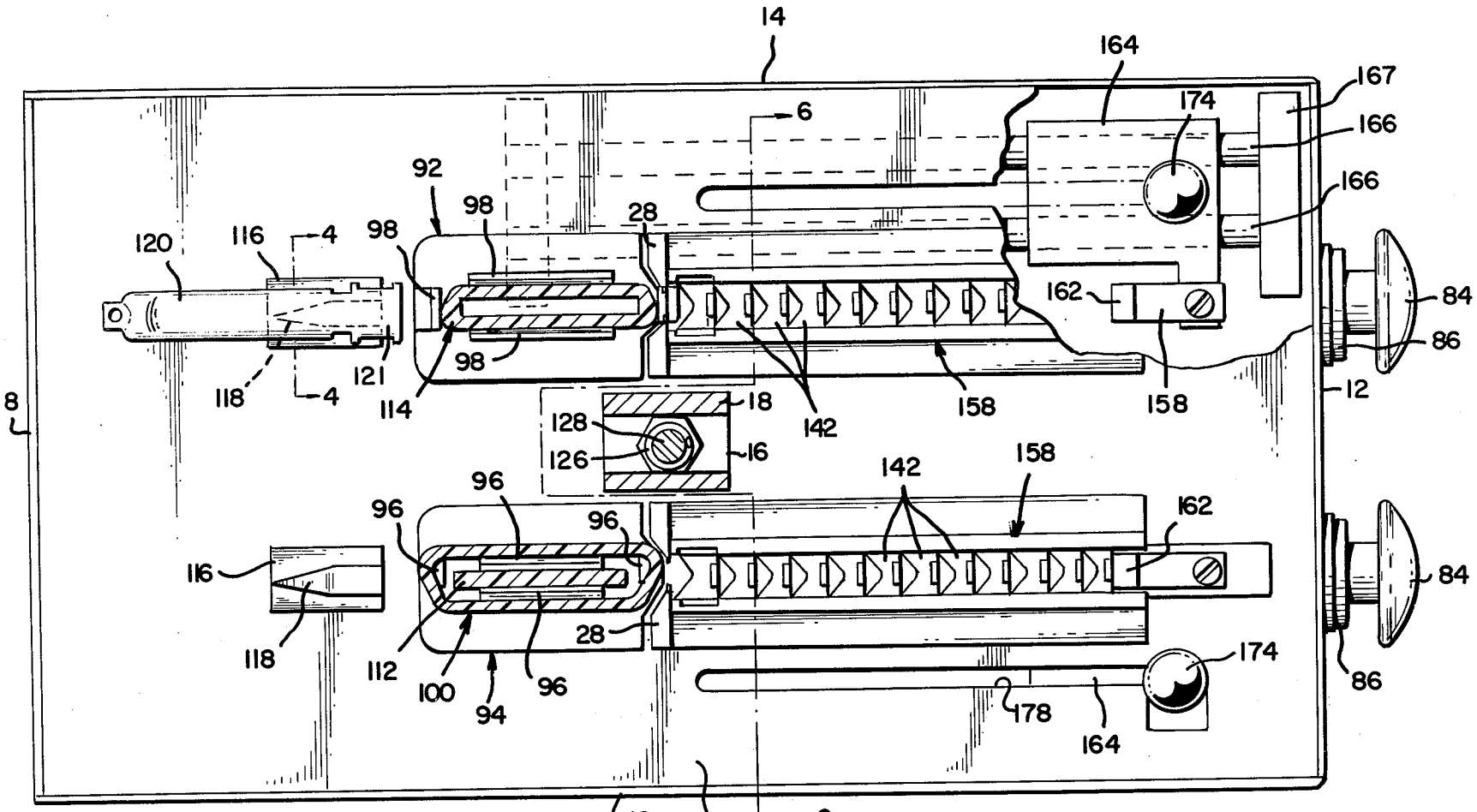
FIG. 5 is a plan view of the apparatus shown in FIG. 2 together with a male and female connector at corresponding work stations of the apparatus being illustrated in section.

As shown in FIGS. 1, 5, and 6, taken in conjunction with FIGS. 2 and 3, the top plate 6 includes a pair of work stations 92 and 94 on either side of the mast portion 18. Each work station includes a pedestal on which are mounted locating blocks 96 and 98 respectively. As shown in FIG. 5, four blocks 96 are arranged to fit internally of a male connector housing 100 of the type disclosed in U.S. Pat. No. 3,760,335. The connector is pictorally represented in FIGS. 2 and 5 as having a mating side 102 and a wire terminating side 104 into which are terminated insulated wires 106 of a sheath covered multiconductor cable 108. End flanges 110 separate the mating side 102 from the wire terminating side 104. As shown in FIGS. 3 and 5, when the male connector portion 100 is mounted over the locating blocks 96, an elongated plug portion 112 of the connector will be confined within and encircled by the blocks 96. In similar fashion, as shown in FIG. 5, a female connector, illustrated at 114, when mounted on the work station 92, will be encircled by and confined within the positioning blocks 98. The details of the female connector are disclosed in U.S. Pat. No. 3,760,335. It should be understood that either a male connector 100 or a female connector 114 will be connected to the cable wires 106 as desired. However, in some applications, a cable 108 is terminated at opposite ends with a male connector 100 and a female connector 114. Both ends of the cable together with its associated connectors may be positioned on the work stations 94 and 92.

Figures 4, 7:
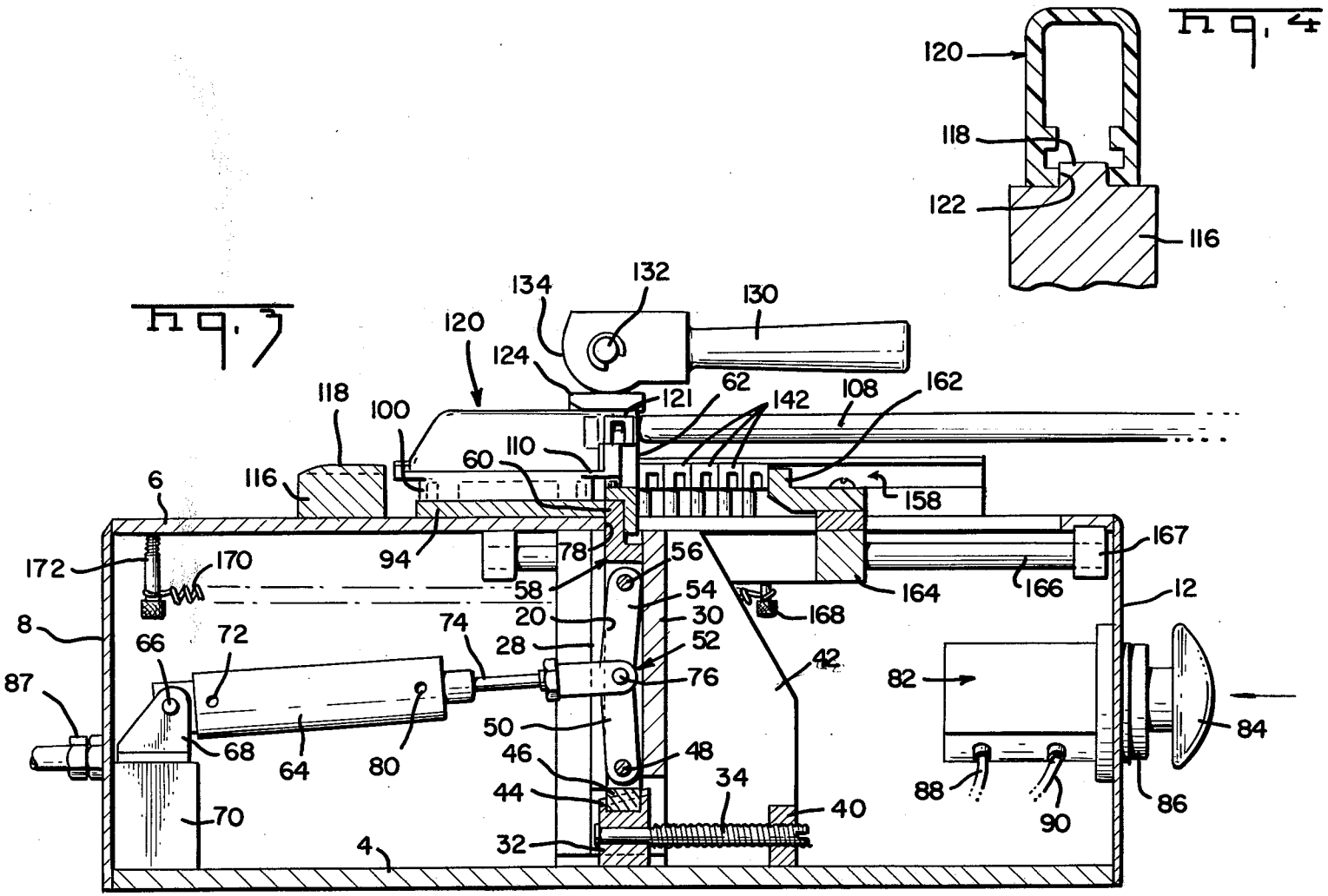
FIG. 4 is a fragmentary elevation in section illustrating alignment of a cover on a guiding feature of the apparatus which assists in assembly of the cover to the connector-cable subassembly.
FIG. 7 is an enlarged fragmentary three dimensional view illustrating an exemplary stain relief clip together with the working end of an insertion ram which assemblies the clip to the cover.

As shown more particularly in FIGS. 1, 2, 3, 4, and 5, the top plate 6 has mounted thereon projecting bosses 116 which are adjacent to corresponding work stations 92 and 94. Each boss 116 is provided thereon with a rib 118 elongated in alignment with the longitudinal dimension of a corresponding male connector 100 or female connector 114 mounted on the corresponding work stations 94 or 92. Each rib 118 is tapered at one end furthest away from the corresponding connector. An elongated connector cover 120 is shown in FIGS. 2, 3, and 4. Each connector cover includes an integral cantilever portion 121 adapted to cover a cable end portion. Each cover further is provided with an open side 122 which slidably assembles over the wire terminating side 104 of a male connector 100 or alternatively over the mating side of the female connector 114. To assist in assembly of the cover, an operator first aligns the open side 122 of the cover 120 over a corresponding projecting rib 118. The operator then utilizes the rib 118 as a rail to slidably guide and transfer the cover 120 from the boss 116 to assembly with the connector 100 as shown in FIG. 3. The cover 120 covers the wires 106 in the wired terminating side 104, with the cover portion 121 overlying an end portion of the cable 108.

As shown more particularly in FIGS. 2, 3, and 6, the projecting tower portion 18 is provided thereon with an elongated pressure platen 124, shown in FIG. 1 as overlying each of the work stations 92 and 94, mounted to the tower for reciprocation toward and away from the work stations. A compressible coil spring 126 resiliently biases the platen outwardly away from the work stations 92 and 94. The spring 126 is mounted over a central threaded fastener 128 which passes freely through the platen 124 and through a slotted end 129 of a pivotable hand lever 130. Fastener 128 makes a clevice connection with a transverse shaft 132 which pivotably supports the lever 130. The slotted end 129 of the lever includes a cam surface 134 which is arcuate and eccentric with respect to the shaft 132 such that when the lever 130 is pivoted from its position shown in FIG. 1 to its position shown in FIG. 3, the cam surface 134 will be caused to slidably displace over the platen 124 causing downward displacement of the same into clamped relationship over each corresponding connector cover 120. As shown in FIG. 3, the platen 124 overlies the cable strain relief portion 121 of the cover 120 and also partially overlies a portion of the connector-cover subassembly, clamping the same to the work station 94. The strain relief portion 121 of the cover overlies the opening 78 in the top plate 6 and is, therefore, in vertical alignment with the ram portion 62.

Figure 8:
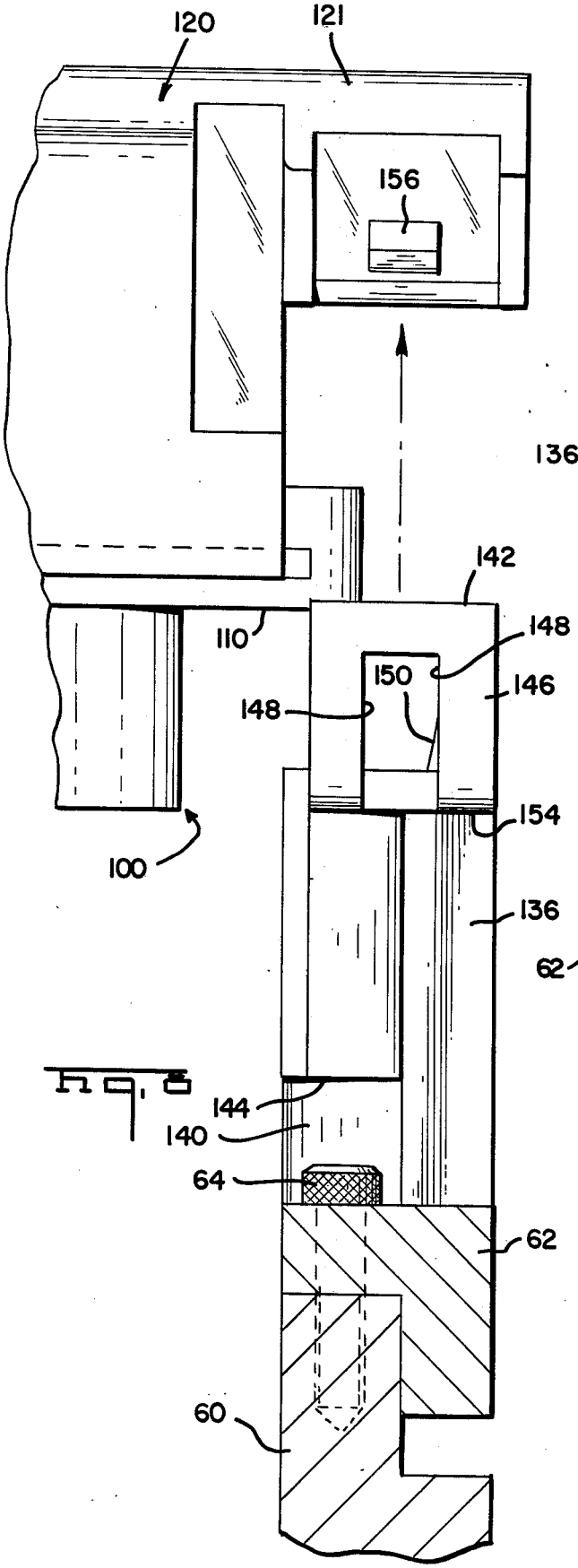
FIG. 8 is a fragmentary elevation of the clip shown in FIG. 7 being propelled by the ram into assembly with a corresponding cover.
Figure 9:
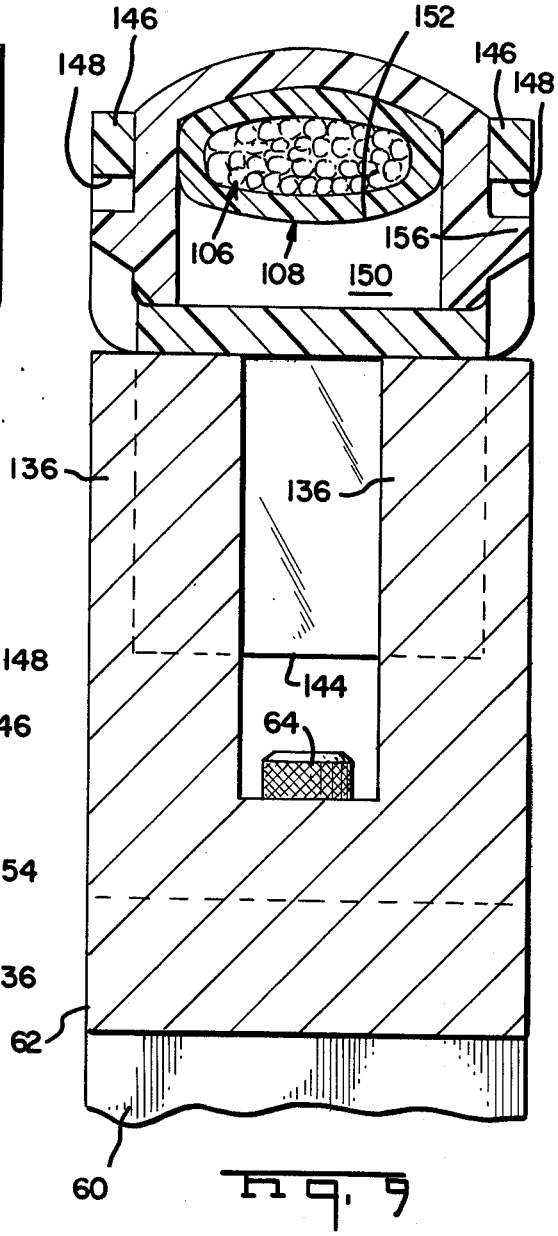
FIG. 9 is a fragmentary elevation of the ram at the completion of its insertion stroke whereby the clip is self latched to the cover in clamped relationship on a cable.

As shown in FIGS. 7, 8 and 9, the ram portion 62 is bifurcated to provide a pair of pedestals 136 separated by a vertical opening 138 which is laterally, outwardly flared at 140. A strain relief clip is shown generally at 142 and is provided with an arcuate body portion 144 having a pair of integral hasp portions 146, each of which includes a central slotted opening 148. Between the hasp portions, and extending in a direction transversely therebetween, is an integral projecting flange 150 having an arcuate edge 152. The strain relief clip 142 is positioned on the ram portion 62, as shown in FIGS. 8 and 9, with the body portion 144 received in the flared portion 140, and with an inverted shoulder 154 partially under the hasp portions 146 in registration against the tops of the pedestals 136. The pedestals 136 are, therefore, in vertical alignment with the flange 150. With the strain relief clip 142 carried on the ram portion 62 as described, vertical reciprocation of the ram will assemble the strain relief clip to the connector-cover subassembly. More specifically, as shown in FIGS. 8 and 9, the ram will project the strain relief clip vertically upward, with the hasp portions 146 receiving therebetween the cantilever portion 121 of the cover 120. The hasp recesses 148 will be received over latches 156 formed integral with the connector portion, locking the strain relief clip to the connector 120. The flange 150 will compress against that portion of the cable 108 which is within the connector portion 121. The cable 108 will be compressed to an oval configuration as shown in FIG. 9, and will be compressibly clamped between and by the plate 150 and the connector portion 121 to provide a strain relief for resisting pulling and twisting forces applied to the cable-connector assembly. The arcuate body portion 144 of the strain relief clip will overlap the end of the flange portion 100 of the connector 100.

With more particular reference to FIGS. 1, 2, 3, and 6 a plurality of clips 142 are contained in an elongated storage magazine 158, mounted on the top plate 6 for supplying a corresponding work station 92 and 94. Each magazine contains a longitudinal channel track 160 which is generally T-shaped in cross section as shown in FIG. 6. The T-shaped cross section slidably supports the pairs of hasp portions 146 of a plurality of strain relief clips 142. The opening 78 is in the form of a longitudinal slot aligned with a corresponding channel 160. An elongated finger 162 projects upwardly through each opening 78 in registration with the cavity 160. The finger 162 projects upwardly from a carriage 164 contained within the housing and slidably mounted on a corresponding pair of rails 166. Each carriage has an inverted projecting fastener 168 secured at one end to an elongated coil spring 170. As shown in FIG. 3, the other end of the coil spring 170 is secured to another threaded fastener 172 in the housing secured to the top plate 6. As shown in FIGS. 1, 5, and 6, each carriage is provided with a knob 174 mounted on a shaft 176 which is pivotally secured to the carriage 164 by a pin 167, and slidably disposed in an L-shaped slot 178. The rails 166 are supported by mounting blocks 167, 177 secured to the top plate 6.

The coil spring 170 provides a biasing force to the carriage 164 for slidably urging the carriage from right to left as shown in FIGS. 2 and 3. A plurality of serially arranged strain relief clips 142 are thereby urged toward the end of the opening 78 which is in alignment with the vertically reciprocating ram 58. To resupply the corresponding magazine, an operator must first grasp the knob 174 and displace the carriage against the tension of the coil spring 170, thereby retracting the finger 162 away from the work station.

Although a preferred embodiment of the present invention is disclosed in detail other modifications and embodiments which would be obvious to one having ordinary skill in the art are intended to be covered by the spirit and scope of the appended claims.

I claim:

1. Apparatus for assembling a cover and strain relief clip to a multiconductor cable having the individual conductors thereof terminated with a multicontact connector, comprising:

a housing, a work station on said housing, a magazine on said housing for supplying serially a plurality of strain relief clips to said work station, a ram internally of said housing and reciprocating from said housing to said work station, a support tower from the floor of said housing to said work station and supporting said ram, a fixture on said housing for positioning a multicontact connector at said work station, a boss projecting from said housing and in alignment with said fixture for aligning and slidably guiding a cover first along said boss and then a slidable assembly on said connector, said tower extending outwardly of said housing beyond said work station and supporting a pressure platen, first means on said tower for actuating said platen toward a work station to clamp a multicontact connector in position at said work station, and second means for slidably actuating said ram to engage and insert a clip into a cover positioned and clamped at said work station together with said connector.

2. The structure as recited in claim 1, and further including:

third means for disabling actuation of said second means until said platen clamps said connector.

* * * * *